United States Patent [19]

Krauss et al.

[11] Patent Number: 4,738,919

[45] Date of Patent: Apr. 19, 1988

[54] PHOTOSENSITIVE PHOTOGRAPHIC SILVER HALIDE RECORDING MATERIAL

[75] Inventors: Gerd Krauss, Leverkusen; Günter Renner, Bergisch Gladbach; Erich Wolff, Solingen; Hans Langen, Bonn; Werner Krafft, Leverkusen, all of Fed. Rep. of Germany

[73] Assignee: Agfa Gevaert Aktiengesellschaft, Leverkusen, Fed. Rep. of Germany

[21] Appl. No.: 940,429

[22] Filed: Dec. 11, 1986

[30] Foreign Application Priority Data

Dec. 21, 1985 [DE] Fed. Rep. of Germany ..... 3545611

[51] Int. Cl.[4] ..... G03C 7/32

[52] U.S. Cl. ..... 430/551; 430/505; 430/554

[58] Field of Search ..... 430/551, 558, 505, 502, 430/504, 554

[56] References Cited

U.S. PATENT DOCUMENTS

| | | | |
|---|---|---|---|
| T900,028 | 7/1972 | Rush | 430/607 |
| 4,388,404 | 6/1983 | Morigaki et al. | 430/548 |
| 4,411,987 | 10/1983 | Kobayashi et al. | 430/542 |
| 4,414,309 | 11/1983 | Langen et al. | 430/551 |
| 4,435,503 | 3/1984 | Minayashi et al. | 430/548 |
| 4,490,460 | 12/1984 | Shimba et al. | 430/504 |
| 4,614,707 | 9/1986 | Fujita et al. | 430/379 |

FOREIGN PATENT DOCUMENTS

| | | | |
|---|---|---|---|
| 0087984 | 9/1983 | European Pat. Off. | 430/554 |

*Primary Examiner*—Paul R. Michl
*Assistant Examiner*—Patrick A. Doody
*Attorney, Agent, or Firm*—Connolly & Hutz

[57] ABSTRACT

A photographic recording material containing at least one pyrazolone in at least one non-photosensitive layer I, a compound Sc, which reacts with the oxidation product of a p-phenylene diamine developer to form substantially colorless products and which is contained in a non-photosensitive layer which is not separated from the layer I by a photosensitive silver halide emulsion layer, shows improved protection against formaldehyde.

5 Claims, No Drawings

PHOTOSENSITIVE PHOTOGRAPHIC SILVER HALIDE RECORDING MATERIAL

This invention relates to a photographic silver halide recording material showing improved stability in storage.

It is known that color photographic images can be produced by chromogenic development, i.e. by developing a recording material comprising at least one silver halide emulsion layer which has been exposed imagewise with so-called color developers in the presence of suitable color couplers, the developer oxidation product formed in consistency with the silver image reacting with the color coupler to form a dye image.

In practice, both the color couplers and the dyes obtained therefrom by chromogenic development have to satisfy a number of requirements. The color couplers and the dyes obtained therefrom must be sufficiently stable to light, elevated temperature and moisture. This applies both to fresh material and also to processed material.

In general, the compounds derived from 5-pyrazolone are used as magenta couplers, i.e. as color couplers suitable for producing the magenta dye image.

Where pyrazolone couplers of the type in question are used, their reactivity with formalin has been increasingly found to be a disadvantage. The sensitivity and maximal color density of the color photographic recording materials are both adversely affected by reaction with formalin which is present in traces in the atmosphere and which is released over prolonged periods, in particular from wood-based products or plastics of the type used in furniture production. This effect becomes particularly serious when a color photographic recording material containing color couplers of the type in question is exposed or stored without exposure for prolonged periods in a formalin-containing environment, for example in relatively new plastic cabinets or in cabinets glued with phenol-formaldehyde resins, before it is developed.

In addition, the gelatin layers of which the photographic material is made up have to be hardened to acquire mechanical strength. If aldehydes are used as hardeners for this purpose, the disadvantages referred to above can arise because excess hardener reacts with the pyrazolone coupler.

Various proposals have already been put forward with a view to overcoming this disadvantage. Thus, it is known from DE-OS No. 1 772 816 for example that N,N'-ethylene urea, 2,3-dihydroxynaphthalene or dimedon for example may be added to photographic layers in order to fix formaldehyde. DE-OS No. 2 332 426 describes a photographic recording material which, in addition to a vinylsulfonyl hardener, contains an acyclic urea in one of its colloid layers to remove aldehyde. U.S. Pat. No. 3,652,278 relates to a process for reducing fogging in photographic materials which are stored in a formaldehyde-containing atmosphere. Thereafter, a compound from the group comprising N,N'-ethylene urea, 2,3-dihydroxynaphthalene and 1,1-dimethyl-3,5-diketocyclohexane is incorporated in the silver halide emulsion of the material. In addition, it is known from JP-PS No. 76 023 908 that 2,4dioxoimidazolines are suitable as aldehyde-removing agents in color materials.

In order to obviate the above-mentioned disadvantages caused by aldehydes, attempts have been made to process photographic materials containing an aldehyde hardener in the presence of an organic compound which is capable of reacting with the aldehyde. The compounds in question include hydroxylamines, hydrazines, hydrazo compounds, semicarbazides, naphthalene diamines and dimethyldihydro-resorcinol. U.S. Pat. No. 3,168,400 also relates to a process for stabilizing photographic images, in which the binder of the photographic material is hardened with an aldehyde before development of the material and after exposure and the unused aldehyde is subsequently removed by treatment with an aqueous solution of an amine compound. Suitable amines are, for example, hydroxylamine, semicarbazide, hydrazine, biuret, aminoguanidine, etc. According to DE-OS No. 2 227 144, aldehyde-containing photographic materials are treated in baths containing hydroxylamine or a water-soluble salt of hydroxylamine and an aromatic polyvinyl compound containing two hydroxyl groups in the ortho position, for example an o-dihydroxy compound of the benzene series.

The above-described adverse effect of aldehydes on a photographic material cannot be satisfactorily prevented by any of these known measures. The strong dependence on moisture of the effectiveness of the above-mentioned aldehyde-binding agents is one of a number of disadvantages.

In addition, the photographic properties are impaired by the above-mentioned compounds. Where the iminopyrazolones known from DE-A-31 48 108 and U.S. Pat. No. 4,414,309 are used, the breakage strength of the photographic material can be unsatisfactory.

U.S. Pat. No. T900,028 describes a photographic recording material consisting of at least one photosensitive layer and at least one non-photosensitive layer, the non-photosensitive layer containing a 1,3-disubstituted pyrazolone compound or a benzoyl acetanilide.

However, if the compounds mentioned are stored in intermediate layers in a standard color photographic material according to these publications, a number of photographic disadvantages arise, namely:

Since the compounds mentioned color-couple with developer oxidation product, additional undesirable color formation occurs due to developer oxidation product which is formed imagewise in the emulsion-containing layers and diffuses into the intermediate layers. The color additionally formed leads to a deterioration in sharpness and/or—if the developer oxidation product originates from a layer coupling in a different color—to high secondary densities.

The object of the present invention is to provide a photographic recording material which shows good protection against formaldehyde and improved breakage strength without any adverse photographic effects.

The present invention relates to a photographic recording material comprising a support, at least one photosensitive silver halide emulsion layer S, at least one color coupler associated therewith and at least one pyrazolone in at least one non-photosensitive layer I, characterized in that a compound Sc which reacts with the oxidation product of a standard p-phenylene diamine color developer compound to form substantially colorless products is contained in at least one non-photosensitive layer which is not separated from the layer I by a photosensitive silver halide emulsion layer.

In one preferred embodiment, the compound Sc is arranged in a layer which is arranged between the layer I containing the pyrazolone and the uppermost photosensitive layer S.

In another preferred embodiment, the compound Sc and the pyrazolone are present together at least in one layer I. In a particularly preferred embodiment, the compound Sc and the pyrazolone are only present together in one layer or several layers.

In an especially preferred embodiment, the layer I is arranged further away from the support than the uppermost layer S.

The pyrazolones used in accordance with the invention in the layer I preferably correspond to the following formula

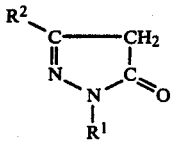

(I)

in which $R^1$ represents hydrogen, an aliphatic or cycloaliphatic group, an aralkyl group, an aryl group, a heterocycle or one of the following groups: —CO-alkyl, —CO-aryl, —CO-heterocycle, —$SO_2$-alkyl, —$SO_2$-aryl, —CO—O-alkyl, —CO—NH—$NH_2$,

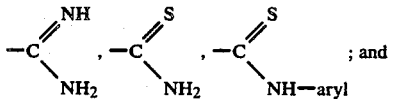

; and $R^2$ represents hydrogen, an aliphatic or cycloaliphatic group, an aralkyl group, an aryl group, alkoxy, aroxy, carboxyl, carbamoyl, alkoxycarbonyl, an alkyl or aryl group attached by a carbonyl group, cyano, an amino group optionally substituted by alkyl, aralkyl, aryl or acyl or a cyclic amino group.

Accordingly, the groups $R^1$ and $R^2$ in the formula may assume a variety of meanings.

Suitable aliphatic groups are, for example, straight-chain or branched alkyl or alkenyl groups, such as methyl, ethyl, isopropyl, tert.-butyl, hexyl, dodecyl, allyl, isopropenyl, 3-vinylethyl. Suitable cycloaliphatic groups are cycloalkyl and cycloalkenyl, such as cyclopentyl, cyclohexyl, bicyclo-[2,2,1]-heptyl, 7,7-dialkylbicyclo-[2,2,2]-heptyl, 2-pentadecyl-7,7-dimethylbicyclo[2,2,1]-heptyl, cyclopentenyl, cyclohexenyl, $\Delta^2$-bicyclo-[2,2,1]-heptenyl.

Examples of aralkyl groups are benzyl and phenethyl groups while examples of aryl groups are phenyl and naphthyl groups.

The alkyl, alkenyl, cycloalkyl, cycloalkenyl, aralkyl and aryl groups mentioned may contain further substituents, such as halogen atoms, nitro, cyano, alkoxy, aroxy, $CF_3$, amino, sulfo, sulfamoyl.

A carbamoyl group represented by $R^2$ may be substituted once or twice at the N-atom, for example by alkyl or aryl or by two groups which together, with inclusion of the N-atom, form a cyclic amino group.

An amino group represented by $R^2$ may be substituted as mentioned above, more especially by a phenyl group (anilino) optionally containing further substituents or by an acyl group (acylamino), the acyl group being derived from an aliphatic or aromatic carboxylic acid or sulfonic acid or from a carbamic acid, a sulfamic acid or from a carbonic acid monoester. A cyclic amino group is, for example, a pyrrolidino, piperidino or morpholino group.

A heterocycle mentioned in the definition of $R^1$ is, for example, pyridyl, thienyl, pyrazolinyl, S,S-dioxothiolyl.

The following are particularly preferred pyrazolones of the type in question:

Pp 1

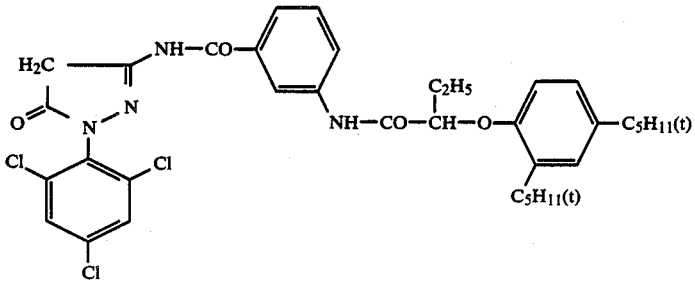

Pp 2

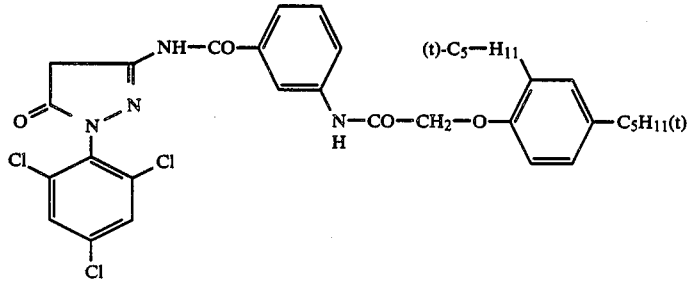

-continued
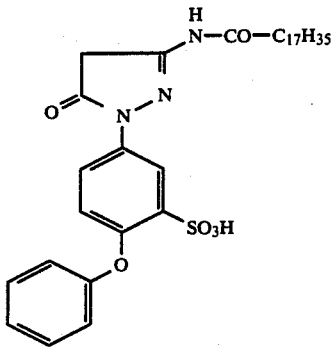
Pp 3
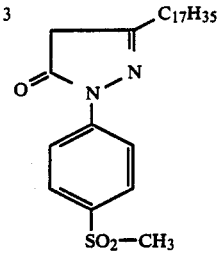
Pp 4
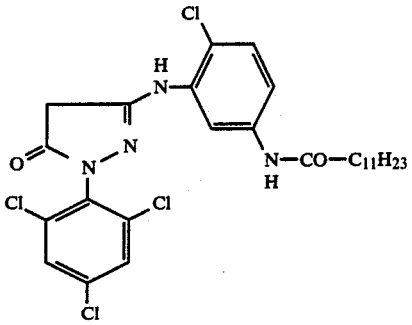
Pp 5
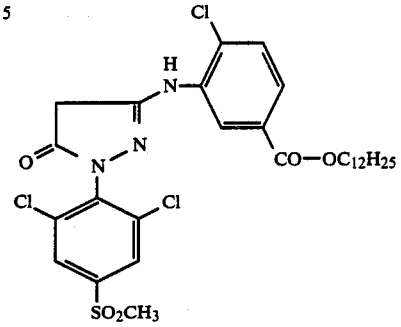
Pp 6
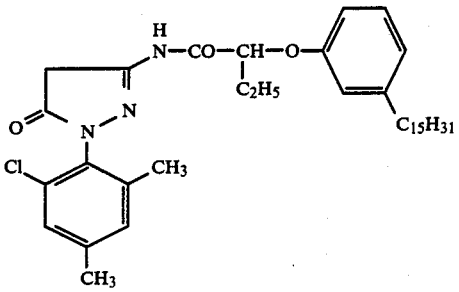
Pp 7
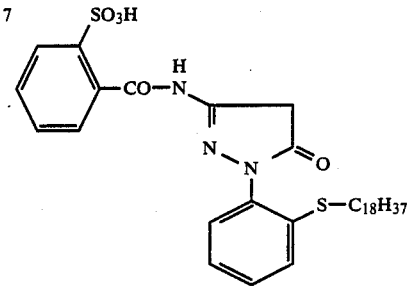
Pp 8
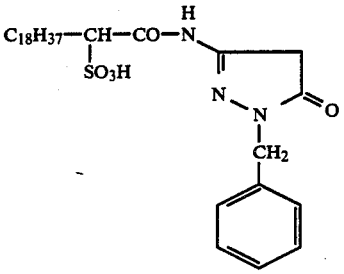
Pp 9
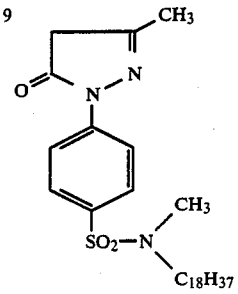
Pp 10
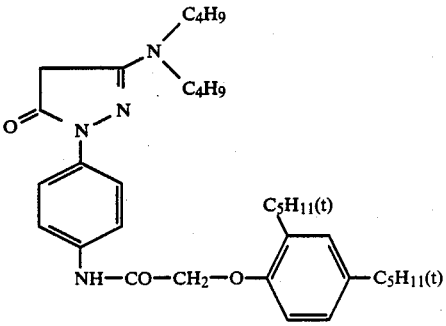
Pp 11
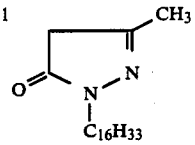
Pp 12

-continued
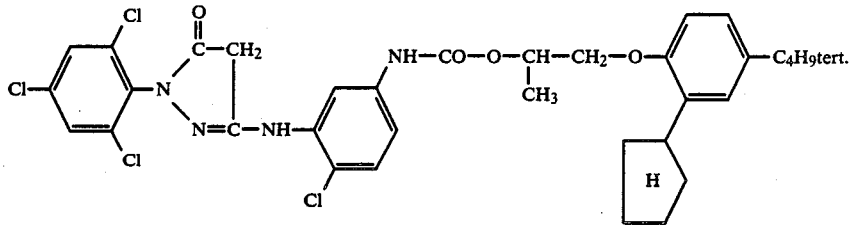
Pp 13
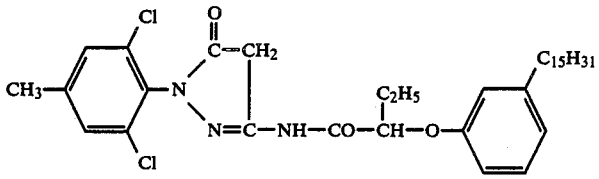
Pp 14
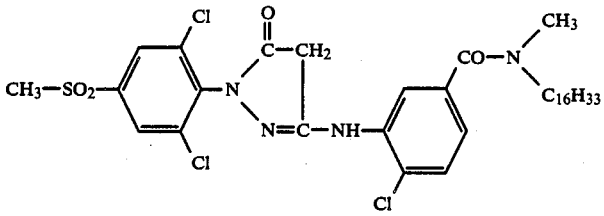
Pp 15
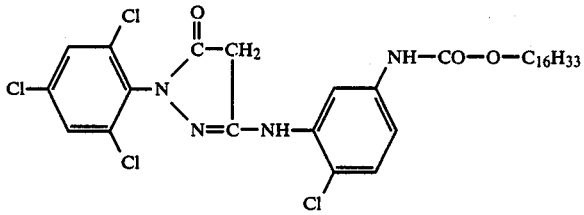
Pp 16
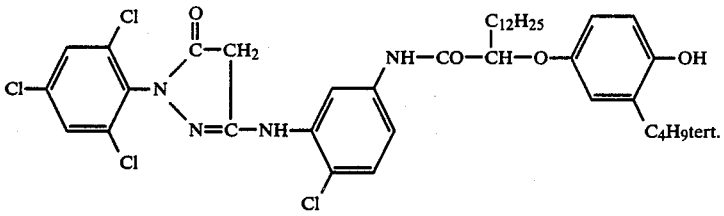
Pp 17
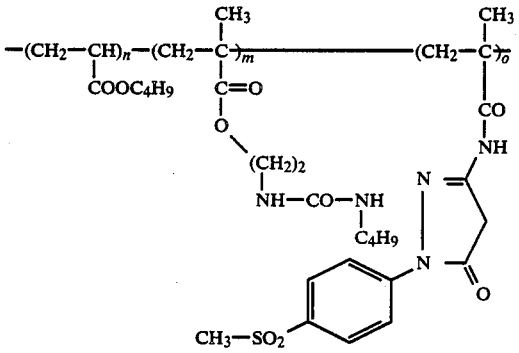
Pp 18
n=30–70%
m=10–20%
o=20–50%
Particularly suitable compounds Sc are the so-called white couplers and oxform binding agents.
Particularly preferred compounds of this type correspond to the following formula
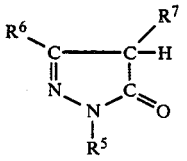
II in which $R^5$ is an optionally substituted alkyl or aryl group, $R^6$ is an optionally substituted alkyl or aryl group

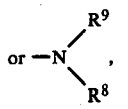

$R^7$ is an optionally substituted alkyl, aryl or acyl group, more especially a $C_1$–$C_4$ alkyl group, $R^8$ and $R^9$ may be the same or different and represent hydrogen or an optionally substituted alkyl, aryl or acyl group.

The following are particularly preferred compounds Sc:

Sc 1

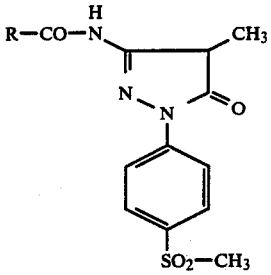

Sc 1.1: Sc 1 with R = $-O-CH_2-CH_2-O$

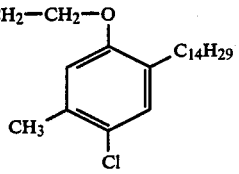

Sc 1.2: Sc 1 with R =

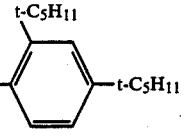

Sc 2

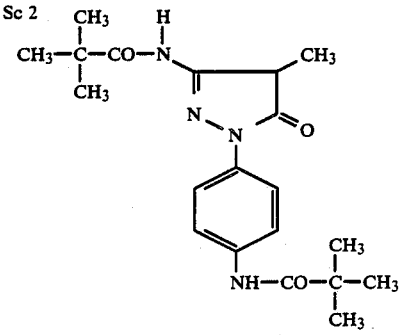

Sc 3

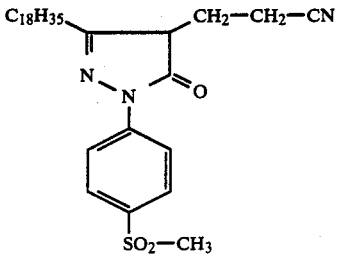

-continued

Sc 4

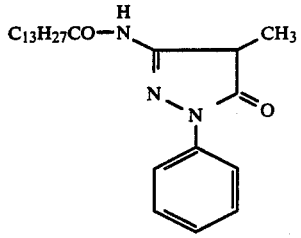

Sc 5

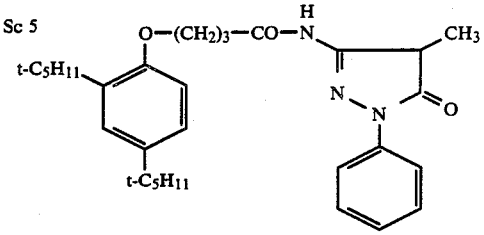

Sc 6

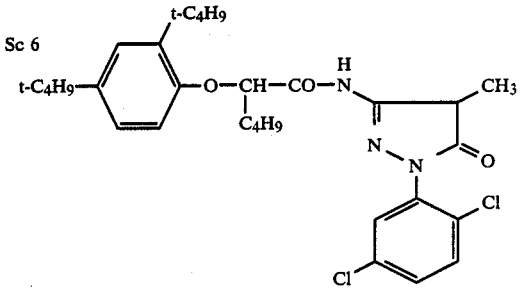

Sc 7

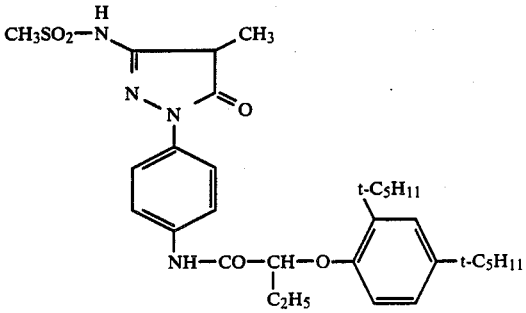

Sc 8

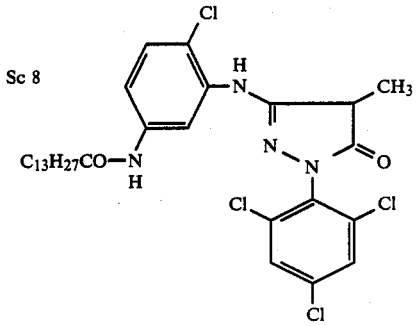

-continued

Sc 9

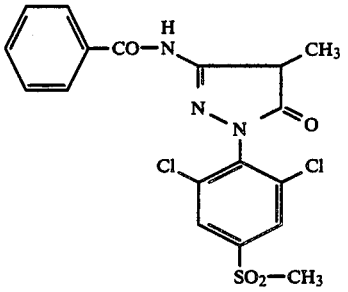

Sc 10

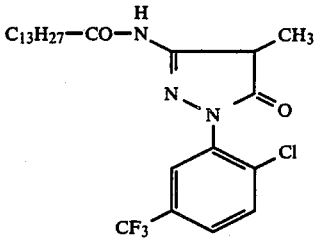

Sc 11

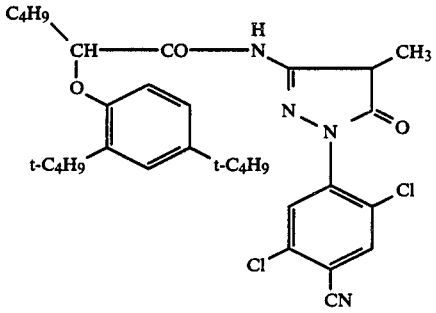

Sc 12

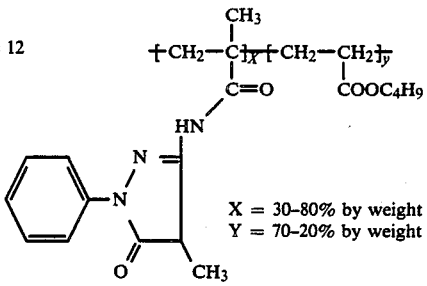

X = 30–80% by weight
Y = 70–20% by weight

Other preferred compounds Sc correspond to the following formula:

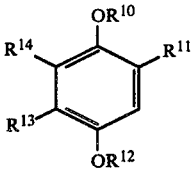

III in which $R^{10}$ and $R^{12}$ may be the same or different and represent hydrogen, alkyl, more especially containing from 1 to 8 carbon atoms, aryl, more especially phenyl, or —CO—$R^{15}$ and $R^{11}$, $R^{13}$ and $R^{14}$ may be the same or different and represent hydrogen, alkyl, more especially containing from 1 to 16 carbon atoms, and $R^{15}$ represents alkyl, more especially containing from 1 to 14 carbon atoms, aryl, more especially phenyl, alkoxy, more especially containing from 1 to 14 carbon atoms, aryloxy, more especially phenoxy, or alkylamino, more especially containing from 1 to 8 carbon atoms, and in which $R^{13}$ and $R^{14}$ or $R^{13}$ and $R^{12}$ may together form the members required to complete a ring, more especially a 5-membered or 6-membered ring.

The following are particularly preferred compounds of formula III:

Sc 20

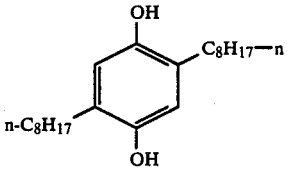

Sc 21

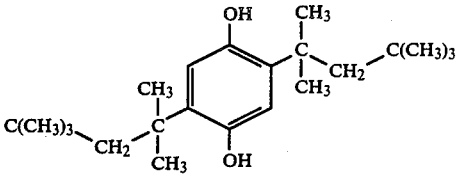

Sc 22

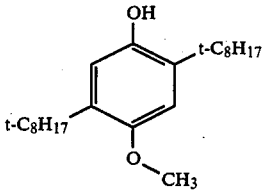

Sc 23

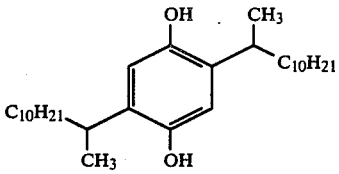

Sc 24

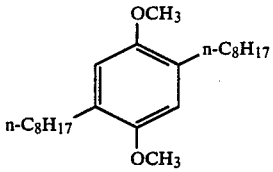

Sc 25

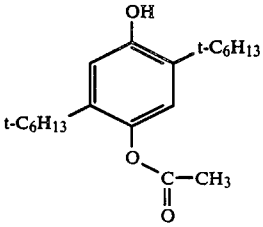

-continued

Sc 26

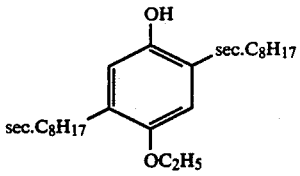

Sc 27

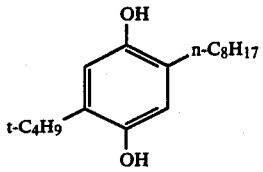

Sc 28

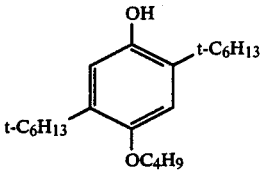

Sc 29

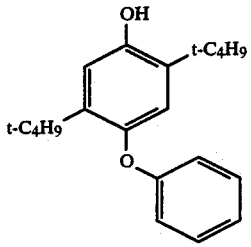

Sc 30

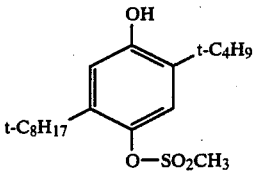

Sc 31

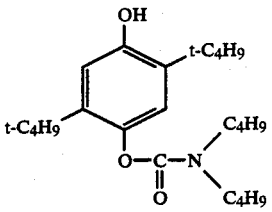

Sc 32

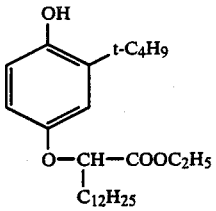

Sc 33

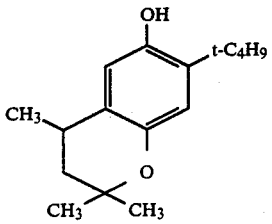

-continued

Sc 34

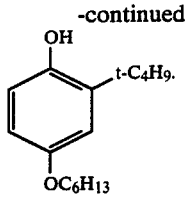

The optimal quantities of the compounds used in accordance with the invention are easy to determine. In order effectively to protect color photographic recording materials against damage by aldehydes during storage, at least 0.2 g of the pyrazolone and at least 0.005 g of the compound Sc are generally used per square meter of the recording material to be protected. Quantities of from 0.5 to 1.50 g/m$^2$ have proved to be particularly favorable.

The color photographic recording materials normally contain at least one silver halide emulsion layer unit for recording light of each of the three spectral regions red, green and blue. Each of the silver halide emulsion layer units mentioned may contain a single silver halide emulsion layer or even several silver halide emulsion layers. Color photographic recording materials containing double layers for the various spectral regions are known, for example, from U.S. Pat. Nos. 3,663,228, 3,849,138 and 4,184,876.

Color photographic recording materials containing triple layers are known from DE-OS No. 2 018 341 and from DE No. 3 413 800.

In addition, the iminopyrazolones known from DE-A-3 148 108 and from U.S. Pat. No. 4,414,309 may be present in any layer. In addition, a coupler, more especially a yellow coupler, for example of the substituted benzoyl acetanilide or pivaloyl acetanilide type, such as $Y_1$–$Y_{12}$, may be introduced into one of the non-photosensitive layers mentioned above the uppermost photosensitive silver halide emulsion layer.

Preferably, at least one blue-sensitive layer is arranged above the green-sensitive and red-sensitive layers and is separated therefrom by a yellow filter layer. In addition to the photosensitive layers, it is possible to use other protective and intermediate layers.

The component layers may additionally contain the usual constituents, such as for example scavengers, DIR couplers and also DAR couplers.

In addition to the layers already mentioned, other non-photosensitive auxiliary layers may be present in the color photographic recording material according to the invention, for example adhesion layers, antihalo layers or cover layers, more especially intermediate layers between the photosensitive layers in order effectively to prevent the diffusion of developer oxidation products from one layer into another. To this end, intermediate layers of the type in question may also contain certain compounds which are capable of reacting with developer oxidation products. Layers such as these are preferably arranged between adjacent photosensitive layers of different spectral sensitivity. It is also possible to incorporate in intermediate layers a silver halide emulsion of low sensitivity with an average particle diameter of around 0.1 μm or less, which contains chloride, bromide and optionally iodide. A layer such as this has a particularly favorable effect upon the sensitivity of the adjoining layers. However, the low-sensitivity silver halide emulsion may also be directly introduced into the photosensitive layers.

Color couplers capable of reacting with color developer oxidation products to form a dye are preferably associated with the photosensitive silver halide emulsion layers. The color couplers are preferably immediately adjacent the silver halide emulsion layer and, more preferably, are actually present therein.

Thus, the red-sensitive layer may contain for example a color coupler for producing the cyan component color image, generally a coupler of the phenol or α-naphthol type. The green-sensitive layer may contain, for example, at least one color coupler for producing the magenta component color image, normally a color coupler of the 5-pyrazolone type. The blue-sensitive layer may contain, for example, at least one color coupler for producing the yellow component color image, generally a color coupler containing an open-chain ketomethylene group.

The color couplers may be, for example, 6-, 4- or 2-equivalent couplers. Suitable couplers are known, for example, from the following publications: "FarbKuppler (Color Couplers)" by W. Pelz in "Mitteilungen aus den Forschungslaboratorien der Agfa, Leverkusen/-Munchen", Vol. III, page 111 (1961): K. Vekataraman in "The Chemistry of Synthetic Dyes", Vol. 4, 341 to 387, Academic Press (1971); T. H. James in "The Theory of the Photographic Process", 4th Edition, pages 353 to 362 and Research Disclosure No. 17643 of December, 1978, Section VII, published by Industrial Opportunities Ltd., Homewell, Havant, Hampshire, PO9 1 EF, United Kingdom.

The usual masking couplers may be used to improve color reproduction. In addition, the recording material may contain DIR compounds and other white couplers which do not produce any dye on reaction with color developer oxidation products. The inhibitors releasable from the DIR compounds may be released either directly or through non-inhibiting intermediate compounds.

Reference is made in this connection to GB No. 953 454, U.S. Pat. No. 3,632,345, U.S. Pat. No. 4,248,962 and GB No. 2 072 363 and to Research Disclosure No. 10226 of October, 1972.

Examples of particularly suitable yellow couplers are given in the following Table:

Y1

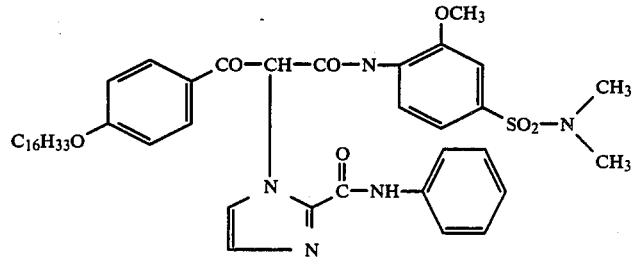

Y2

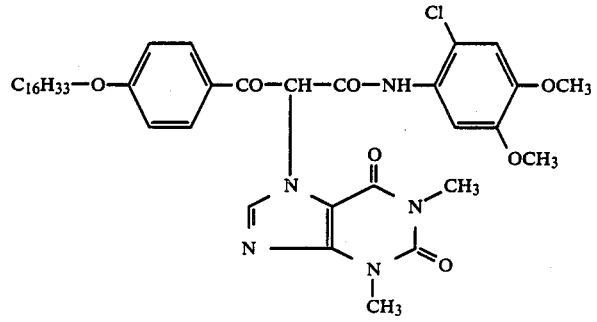

Y3

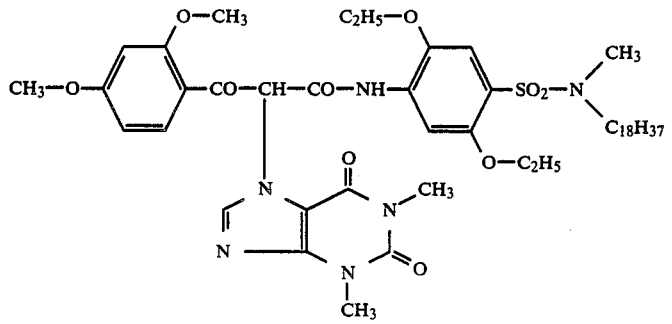

-continued
Y4
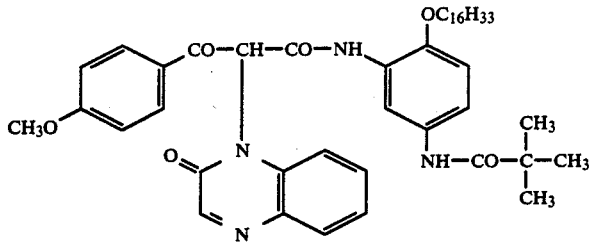
Y5
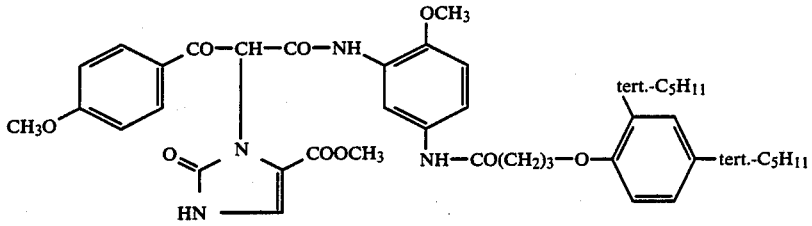
Y6
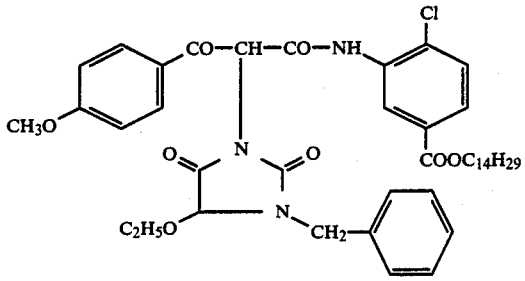
Y7
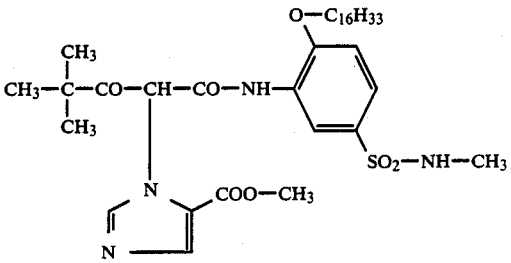
Y8
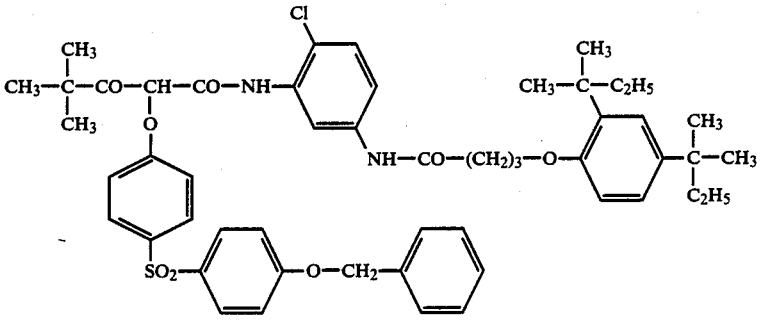
Y9
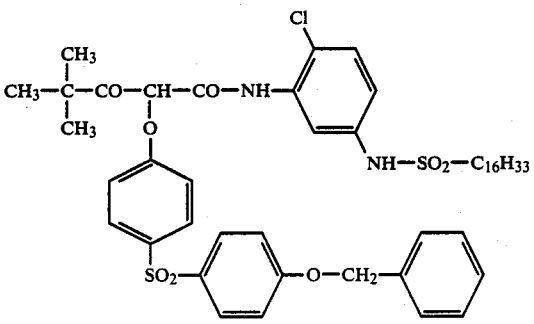

-continued
Y10
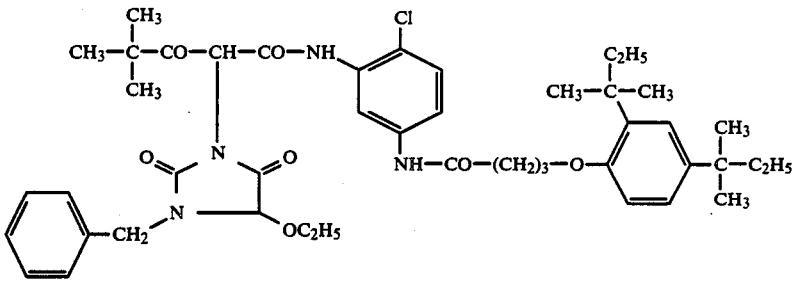
Y11
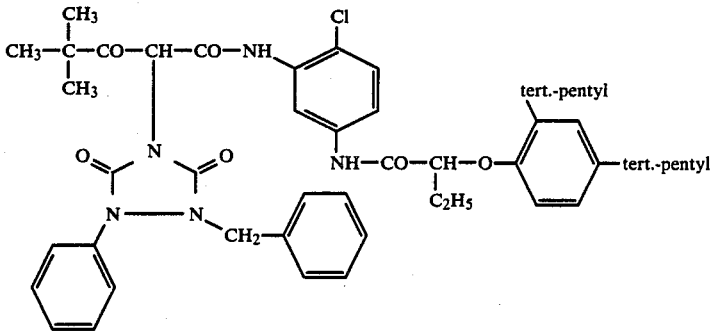
Y12
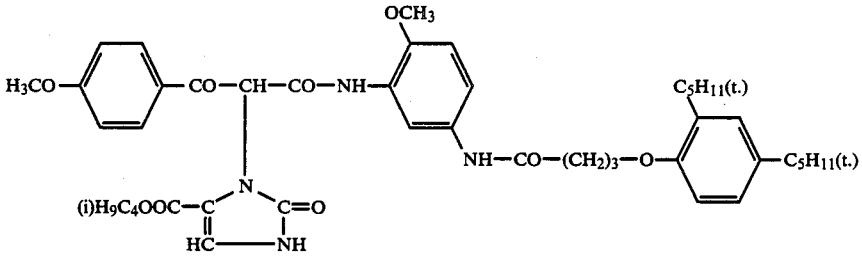
Examples of particularly suitable cyan couplers are given in the following Table:
C1
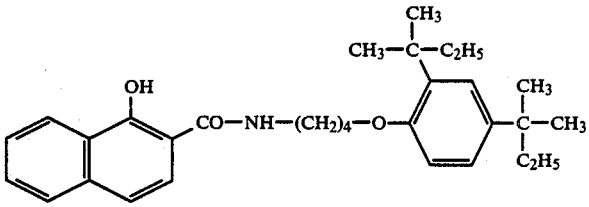
C2
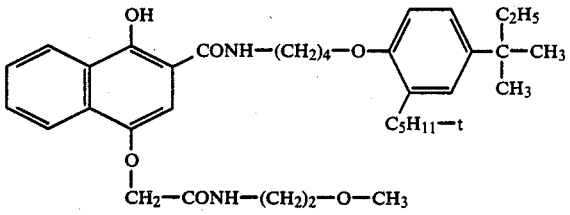
C3
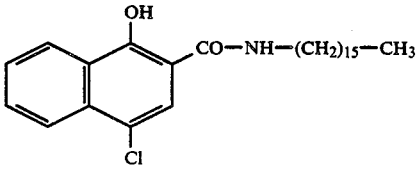

-continued
C4
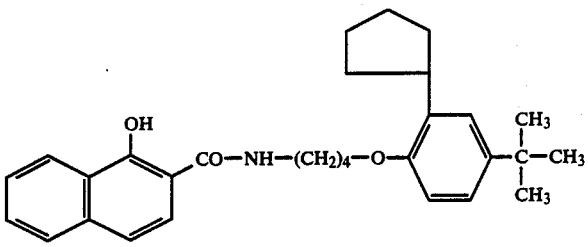
C5
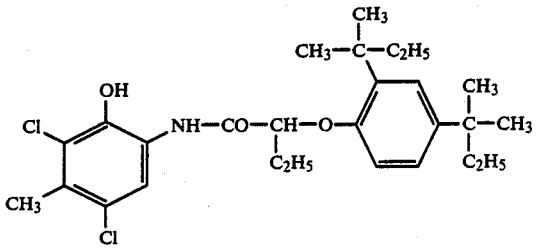
C6
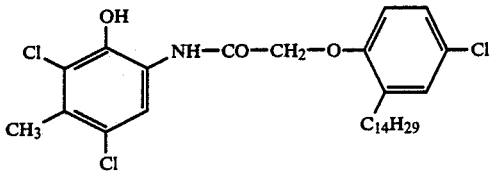
C7
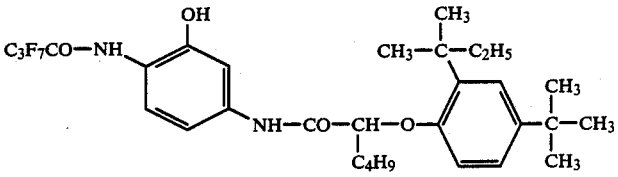
C8
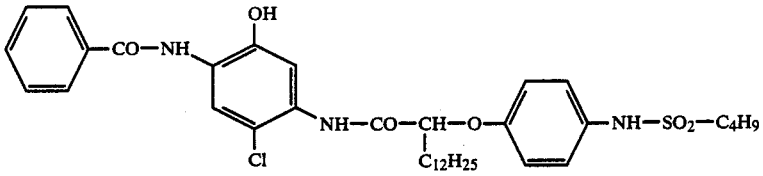
C9
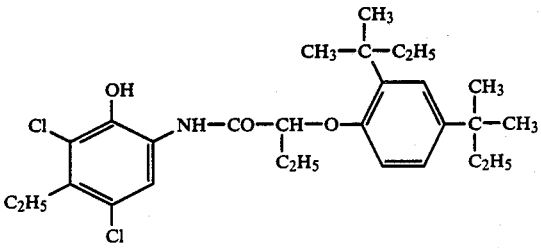
C10
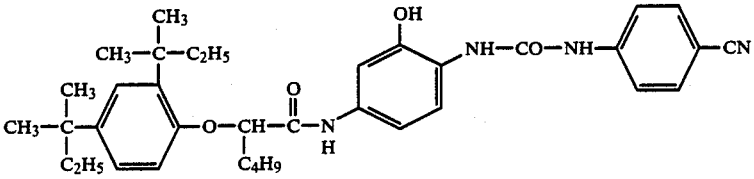
In addition to the compounds Pp1–Pp17 mentioned above, the following compounds for example may also be used as magenta couplers:

M 1
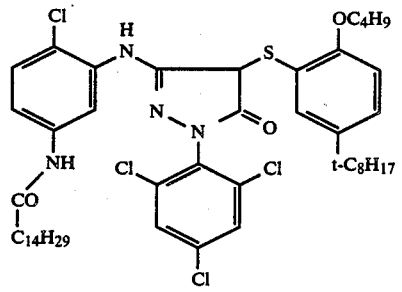
M 2
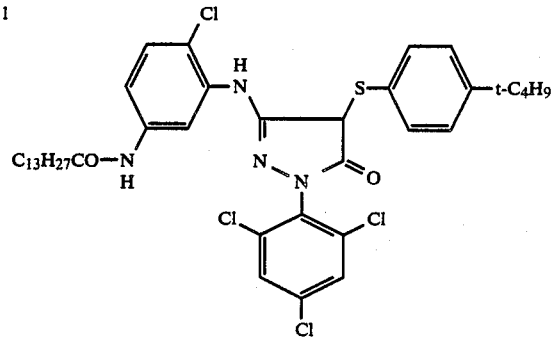
M 3
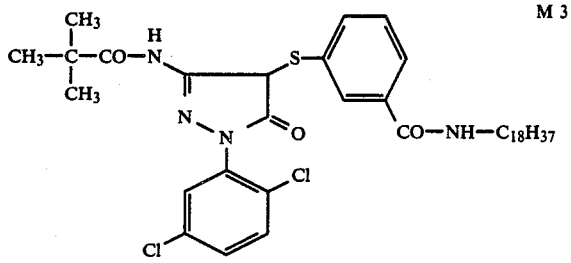
M 4
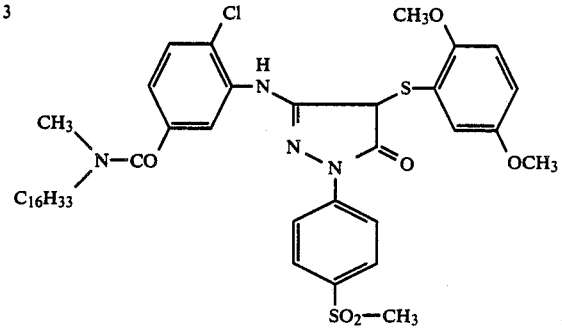
M 5
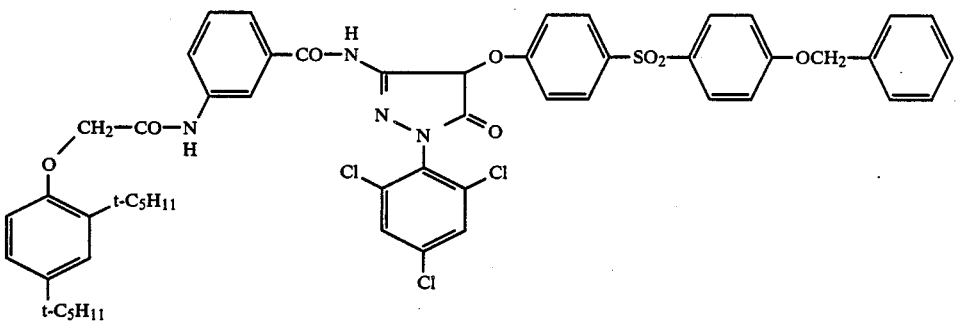
M 6
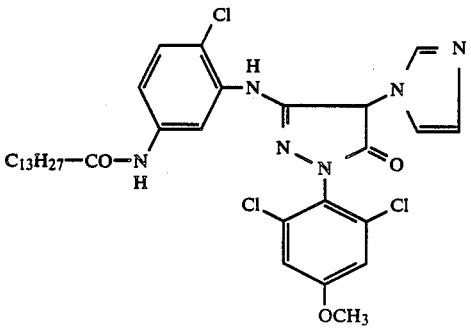
M 7
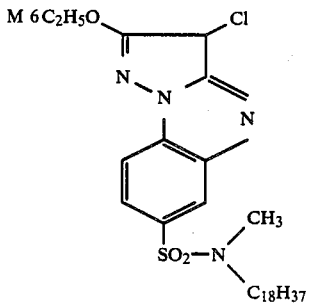

-continued
M 8
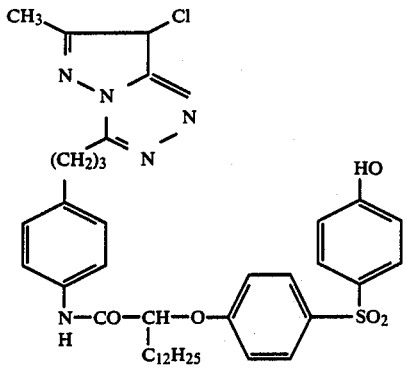
The following are examples of suitable masking couplers:
-continued
DIR 2
M 1
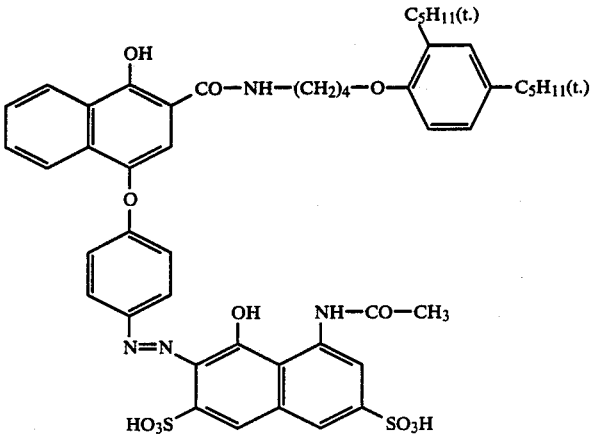
M 2
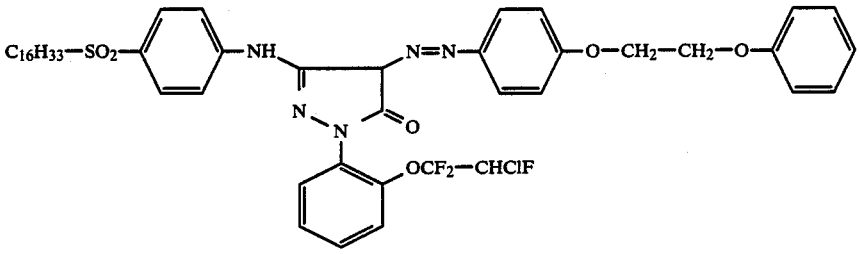
Suitable DIR couplers have the following structure for example:
DIR 1
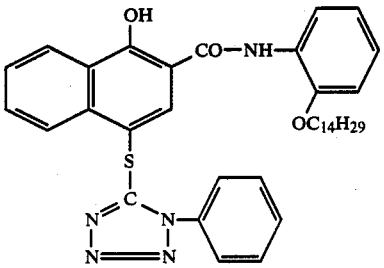
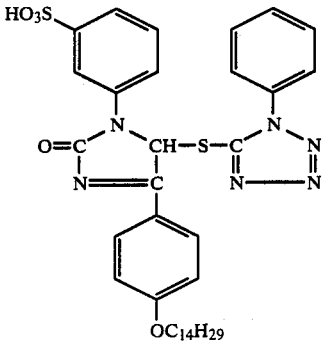

-continued

DIR 3

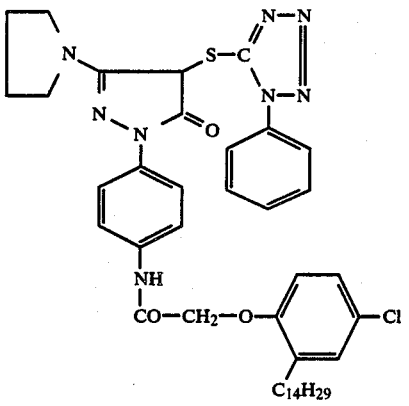

The photosensitive silver halide emulsions used may contain chloride, bromide and iodide or mixtures thereof as halide. In one preferred embodiment, 0 to 12% of the halide of at least one layer consists of AgI, 0 to 50 mole % of AgCl and 50 to 100% of AgBr. In another preferred embodiment, the crystals are predominantly compact crystals which are, for example, cubic or octahedral or have transitional forms. They may be characterized in that they essentially have a thickness of greater than 0.2 μm. The average ratio of diameter to thickness is preferably smaller than 8:1, the diameter of a crystal being defined as the diameter of a circle having an area corresponding to the projected area of the crystal. In another preferred embodiment, however, all the emulsions or individual emulsions may even contain substantially tablet-form silver halide crystals in which the ratio of diameter to thickness is greater than 8:1. The emulsions may be monodisperse emulsions which preferably have an average grain size of from 0.3 μm to 1.2 μm. The silver halide grains may have a layered grain structure.

The emulsions may be chemically sensitized. The usual sensitizers may be used for chemically sensitizing the silver halide grains, sulfur-containing compounds, for example allylisothiocyanate, allylthiourea and thiosulfates, being particularly preferred. Other suitable chemical sensitizers are noble metals and noble metal compounds, such as gold, platinum, palladium, iridium, ruthenium or rhodium. This method of chemical sensitization is described in the Article by R. Koslowsky, Z. Wiss. Phot. 46, 65–72 (1951). The emulsions may also be sensitized with polyalkylene oxide derivatives. Other methods of sensitization are described in the above-mentioned Research Disclosure No. 17 643, Section III.

The emulsions may be optically sensitized in known manner, for example with the usual polymethine dyes, such as neutrocyanines, basic or acidic carbocyanines, rhodacyanines, hemicyanines, styryl dyes, oxonols and the like. Sensitizers such as these are described by F. M. Hamer in "The Cyanine Dyes and Related Compounds", (1964). Particular reference is made in this connection to Ullmanns Enzyklopadie der technischen Chemie, 4th Edition, Vol. 18, pages 431 et seq. and to the above-mentioned Research Disclosure No. 17 643, Section IV.

The usual antifogging agents and stabilizers may be used. Particularly suitable stabilizers are azaindenes, preferably tetra- or pentaazindenes, especially those substituted by hydroxyl or amino groups. Compounds such as these are described, for example, in the Article by Birr in Z. Wiss. Phot. 47, (1952), pages 2–58. Other suitable stabilizers and antifogging agents are described in the above-mentioned Research Disclosure No. 17 643, Section IV. Suitable compounds for improving resistance to formalin are described in U.S. Pat. No. 464,463.

The recording material may contain stabilizers against visible and UV light and for improving stability in storage which may optionally be present in polymeric form. Particularly good stabilizers of this type are, for example, aminoallylidene malonic acid derivatives and benzotriazoles.

The constituents of the color photographic material may be incorporated by known methods. If the compounds in question are water-soluble or alkali-soluble compounds, they may be added in the form of aqueous solutions, optionally with addition of water-miscible organic solvents, such as ethanol, acetone or dimethyformamide. If the compounds in question are insoluble in water and alkalis, they may be incorporated in the recording materials in known manner in dispersed form. For example, a solution of these compounds in a low-boiling organic solvent may be directly mixed with the silver halide emulsion or first with an aqueous gelatin solution and the organic solvent subsequently removed. The resulting dispersion of the particular compound may then be mixed with the silver halide emulsion. It is also possible additionally to use so-called oil formers, generally relatively high-boiling organic compounds which surround the compounds to be dispersed in the form of oily droplets.

In this connection, reference is made, for example, to U.S. Pat. Nos. 2,322,027, 2,533,514, 3,689,271, 3,764,366 and 3,765,897. It is also possible, for example, to incorporate couplers in the form of charged latices, cf. DE-OS No. 2 541 274 and EP-A No. 14 921. In addition, the constituents may also be fixed as polymers in the material, cf. for example DE-OS No. 2 044 992, U.S. Pat. No. 3,370,952 and U.S. Pat. No. 4,080,211.

The usual layer supports may be used for the materials according to the invention, cf. Research Disclosure No. 17 643, Section XVII.

Suitable protective colloids or rather binders for the layers of the recording material are the usual hydrophilic film-forming agents, for example proteins, more especially gelatin. Casting aids and plasticizers may be used. Reference is made in this connection to the compounds mentioned in the above-cited Research Disclosure No. 17 643, Sections IX, XI and XII.

The layers of the photographic material may be hardened in the usual way, for example with hardeners of the epoxide type, the heterocyclic ethylene imine type and the acryloyl type. The layers may also be hardened by the process according to DE-OS No. 2 218 009 in order to obtain color photographic materials which are suitable for high-temperature processing. It is also possible to harden the photographic layers with hardeners of the diazine, triazine or 1,2-dihydroquinoline series or with hardeners of the vinylsulfone type. Other suitable hardeners are known from DE-OS Nos. 2 439 551, 2 225 230, 2 317 672 and from the above-mentioned Research Disclosure No. 17 643, Section XI.

Other suitable additives are mentioned in Research Disclosure No. 17 643 and in Product Licensing Index, December 1971, pages 107 to 110.

Suitable color developers for the material according to the invention are, in particular, those of the p-phenylene diamine type, for example 4-amino-N,N-diethylaniline hydrochloride; 4-amino-3-methyl-N-ethyl-N-β-(methanesulfonamide)-ethylaniline sulfate hydrate; 4-amino-3-methyl-N-ethyl-N-β-hydroxyethylaniline sulfate; 4-amino-N-ethyl-N-(2-methoxyethyl)-m-toluidine di-p-toluene sulfonic acid and N-ethyl-N-β-hydroxyethyl-p-phenylene diamine. Other suitable color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out either separately from or together with one another. Suitable bleaches are the usual compounds, for example $Fe^{3+}$ salts and $Fe^{3+}$ complex salts, such as ferricyanides, dichromates, water-soluble cobalt complexes, etc. Particularly suitable bleaches are iron(III) complexes of aminopolycarboxylic acids, more especially for example ethylene diamine tetraacetic acid, nitrilotriacetic acid, iminodiacetic acid, N-hydroxyethylethylene diamine triacetic acid, alkyliminodicarboxylic acids and of corresponding phosphonic acids. Other suitable bleaches are persulfates.

The invention is further illustrated by the following Examples which discribe preferred embodiments of the invention. Percentages represent percentages by weight, unless otherwise indicated. The iminopyrazolone used in the Examples has the following formula:

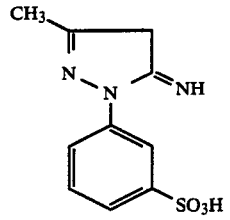

EXAMPLE 1

A multilayer material was prepared by successively applying the layers described hereinafter to a transparent layer support provided with an antihalo layer. The quantities indicated are all based on 1 square meter. For the silver halide coating, the corresponding quantities of $AgNO_3$ are quoted.

1. A red-sensitive layer of relatively low sensitivity (r) containing a red-sensitized mixture of a relatively non-sensitive silver bromide iodide emulsion (5 mole % AgI) containing 2.3 g $AgNO_3$ and a relatively sensitive emulsion (5 mole % AgI) containing 1.4 g $AgNO_3$, 1.5 g gelatin, 670 mg of coupler C 4, 80 mg masking coupler M 1 and 30 mg DIR coupler DIR 1.
2. A red-sensitive layer of relatively high sensitivity (RR) containing a red-sensitized silver bromide iodide emulsion (8 mole % AgI) containing 4.0 g $AgNO_3$, 2.5 g gelatin, 230 mg coupler C 4 and 60 mg DIR coupler DIR 2.
3. An intermediate layer containing 1.0 g gelatin.
4. A green-sensitive layer of relatively low sensitivity (g) containing a green-sensitized mixture of a relatively non-sensitive silver bromide iodide emulsion (5 mole % AgI) containing 1.0 g $AgNO_3$ and a relatively sensitive emulsion (5 mole % AgI) containing 0.4 g $AgNO_3$, 420 mg coupler Pp 1, 50 mg masking coupler M 2 and 25 mg DIR coupler DIR 3.
5. A green-sensitive layer of relatively high sensitivity (GG) containing a green-sensitive silver bromide iodide emulsion (8 mole % AgI) containing 3.4 g $AgNO_3$, 2.0 g gelatin, 510 mg coupler Pp 1, 50 mg masking coupler M 2, 50 mg DIR coupler DIR 2.
6. An intermediate layer containing 0.5 g gelatin
7. A yellow filter layer containing colloidal silver for producing a yellow filter density of 0.6 as measured behind a blue filter.
8. A blue-sensitive layer of relatively low sensitivity (b) containing a mixture of a relatively non-sensitive silver bromide iodide emulsion (5 mole % AgI) containing 0.7 g $AgNO_3$ and a relatively sensitive emulsion containing 0.2 g $AgNO_3$, 1.0 g gelatin, 0.4 g coupler Y 3 and 0.4 g coupler Y 12.
9. A blue-sensitive layer of relatively high sensitivity (BB) containing a silver bromide iodide emulsion (8 mole % I) containing 1.40 g $AgNO_3$, 1.2 g gelatin, 0.25 g coupler Y 3 and 0.25 g coupler Y 12.
10. A first cover layer of 1.0 g gelatin.
11. A second cover layer of 1.0 g gelatin and 0.4 g iminopyrazolone as formalin-binding agent.

EXAMPLE 2

Layer arrangement and layer composition same as in Example 1, except for layer 11 which contains 0.8 g iminopyrazolone in 1 g gelatin.

EXAMPLE 3

Layer arrangement and layer composition same as in Example 1, except for layer 11 which contains in 1 g gelatin 0.5 g of the compound Pp 1 emulsified in 0.5 part by weight tricresylphosphate and 0.4 g iminopyrazolone.

EXAMPLE 4

Layer arrangement and layer composition same as in Example 1, except for layer 10, which contains 0.15 g of the emulsified white coupler Sc 1.1, and for layer 11 which contains in 1 g gelatin 0.5 g of the compound Pp 1 emulsified in 0.5 part by weight tricresylphosphate and 0.4 g iminopyrazolone.

EXAMPLE 5

Layer arrangement and layer composition same as in Example 1, except for layer 11 which contains in 1 g gelatin 0.5 g of the compound Pp 3 (introduced as an aqueous solution) and 0.4 g iminopyrazolone.

EXAMPLE 6

Layer arrangement and layer composition same as in Example 1, except for layer 11 which contains in 1 g gelatin an emulsate of 0.5 g of the compound Pp 1 and 0.1 g of the compound Sc 1.1 in 0.5 part by weight tricresylphosphate and also 0.4 g iminopyrazolone.

EXAMPLE 7

Layer arrangement and layer composition same as in Example 6, except for layer 11 which contains in 1 g gelatin an emulsate of 0.5 g of the compound Pp 1 and 0.1 g of the compound Sc 1.2 in 0.5 part by weight tricresylphosphate and also 0.4 g iminopyrazolone as formalin binding agent.

Description of the formalin test

Mixtures of water/glycerol/30% formaldehyde were introduced into seven 30-liter VA vessels with the same dimensions in accordance with the following schedule:

| Vessel | 1 | 2 | 3 | 4 | 5 | 6 | 7 |
|---|---|---|---|---|---|---|---|
| Water | 69 g | 68.5 g | 68 g | 66.5 g | 65 g | 63 g | 70 g |
| Glycerol | 130 g | 130 g | 130 g | 130 g | 130 g | 130 g | 130 g |
| 30% $CH_2O$ | 1 g | 1.5 g | 2 g | 3.5 g | 5 g | 7 g | — |

The vessels are stored at 23° C. The relative air humidity is 70%.

To test for resistance to formalin, unexposed strips of film are suspended in the vessels. In order to ensure the reproducibility of the results, 10 strips of each material should be used. After 7 days in the vessels, the strips are gradually exposed and developed. The gradation of the strips stored in vessels 1 to 6 is then compared with the gradation of the strips stored in vessel 7. The remaining percentage residual density at the point at which the density of a strip in vessel 7 was 1.5 over fogging is evaluated.

Testing of breakage strength

Breakage strength was tested by the method published in Research Disclosure No. 253, 213–215 (May 1985). The breakage radius and the force required to break a looped film strip of the corresponding test material were measured.

Measurement of color separation

To measure the cyan color separation, the sensitivity interval of the gradation curve of the yellow dye produced by the blue light and the additionally formed density of the magenta dye at 0.2 density units over fogging are measured. The sensitivity interval of the yellow and magenta gradation curve produced by white light is substracted from the sensitivity difference.

The results obtained are shown in the following Table:

| | Example | | | | | | |
|---|---|---|---|---|---|---|---|
| | 1 | 2 | 3 | 4 | 5 | 6 | 7 |
| Color separation (DIN) | 12 | 12 | 6 | 11 | 11 | 12 | 11 |
| Breakage strength | 15 N | 11 N | 20 N | 20 N | 20 N | 20 N | 20 N |
| Residual density (%) after treatment with formalin | | | | | | | |
| Vessel 1 | 75 | 85 | 90 | 90 | 80 | 80 | 80 |
| Vessel 2 | 45 | 60 | 70 | 70 | 70 | 75 | 75 |
| Vessel 3 | 35 | 45 | 60 | 60 | 60 | 65 | 65 |
| Vessel 4 | 25 | 30 | 45 | 50 | 40 | 40 | 45 |
| Vessel 5 | 20 | 25 | 35 | 30 | 35 | 35 | 35 |

It can be seen from the Table that only Examples 4 to 7 according to the invention give good results in regard to color separation, compressive strength and residual density.

We claim:

1. A photographic recording material comprising a support, at least one photosensitive silver halide emulsion layer, at least one color coupler associated therewith, at least one pyrazolone of the formula

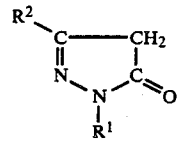

in which $R^1$ represents hydrogen, an aliphatic or cycloaliphatic group, an aralkyl group, an aryl group, a heterocycle or one of the following groups: —CO-alkyl, —CO-aryl, —CO-heterocycle, —$SO_2$-alkyl, $SO_2$-aryl, —CO—O-alkyl, —CO—NH—$NH_2$,

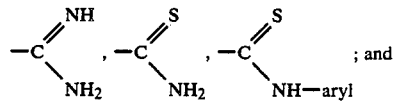

$R^2$ represents hydrogen, an aliphatic or cycloaliphatic group, an aralkyl group, an aryl group, alkoxy, aroxy, carboxyl, carbamoyl, alkoxycarbonyl, an alkyl or aryl group attached by a carbonyl group, cyano, an amino group optionally substituted by alkyl, aralkyl, aryl or acyl or a cyclic amino group in at least one non-photosensitive layer (I) which is arranged further from the support than the uppermost photosensitive layer, and at least a scavenger of the formula

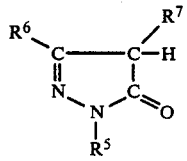

in which $R^5$ is an optionally substituted alkyl or aryl group, $R^6$ is an optionally substituted alkyl or aryl group or

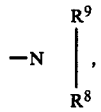

$R^7$ is an optionally substituted alkyl, aryl or acyl group, $R^8$ and $R^9$ may be the same or different and represent hydrogen or an optionally substituted alkyl, aryl or acyl group or of the formula

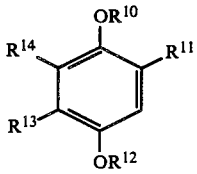

in which $R^{10}$ and $R^{12}$ may be the same or different and represent hydrogen, alkyl, aryl or —CO—$R^{15}$, $R^{11}$, $R^{13}$ and $R^{14}$ may be the same or different and represent hydrogen or alkyl and $R^{15}$ represents alkyl, aralkyl, alkoxy, aryloxy or alkylamino, and in which $R^{13}$ and $R^{14}$ or $R^{13}$ and $R^{12}$ together may represent the members required to complete a ring, which said scavenger being contained in at least one nonphotosensitive layer which is not separated from the layer I by a photosensitive silver halide emulsion layer.

2. A photographic recording material as claimed in claim 1, wherein the scavenger is arranged in a layer which is arranged between the layer containing the pyrazolone and the uppermost photosensitive layer.

3. A photographic recording material as claimed in claim 1, wherein the scavenger is arranged in the layer containing the pyrazolone.

4. A color photographic recording material as claimed in claim 1, wherein the pyrazolone and the compound Sc are incorporated in non-diffusing form.

5. A color photographic recording material as claimed in claim 1, wherein an iminopyrazoline is additionally incorporated in any layer.

* * * * *